United States Patent [19]

McBride, Jr.

[11] 4,094,477

[45] June 13, 1978

[54] TENSION DEVICE FOR HORIZONTAL YARN

[76] Inventor: Edward J. McBride, Jr., P.O. Box 311, Moorestown, N.J. 08057

[21] Appl. No.: 720,904

[22] Filed: Sep. 7, 1976

[51] Int. Cl.[2] ..... B65H 59/22; B65H 59/28

[52] U.S. Cl. ..... 242/152.1; 242/154

[58] Field of Search ..... 242/152.1, 153, 154, 242/147 R, 149 R

[56] References Cited

U.S. PATENT DOCUMENTS

| | | | |
|---|---|---|---|
| 1,040,185 | 10/1912 | Gerstberger | 242/152.1 |
| 1,211,862 | 1/1917 | Lister | 242/152.1 |
| 1,402,894 | 1/1922 | Sawtell | 242/152.1 |

FOREIGN PATENT DOCUMENTS

| | | | |
|---|---|---|---|
| 717,844 | 10/1931 | France | 242/152.1 |
| 12,647 of | 1913 | United Kingdom | 242/152.1 |
| 102,560 | 12/1916 | United Kingdom | 242/152.1 |

*Primary Examiner*—Stanley N. Gilreath
*Attorney, Agent, or Firm*—Weiser, Stapler & Spivak

[57] ABSTRACT

A ball tension device for horizontal yarn comprising generally a body defining a vertical channel within which one or more balls can be positioned to vary yarn tension. A pair of horizontally aligned openings communicate with the bottom of the channel to provide for yarn inlet and outlet as the yarn passes through the device. Similar, ceramic inserts line the inlet and outlet openings and are angularly downwardly inclined to define a pair of opposed, angularly inclined conduits through which the yarn horizontally passes in the tensioning procedure.

18 Claims, 2 Drawing Figures

TENSION DEVICE FOR HORIZONTAL YARN

BACKGROUND OF THE INVENTION

The present invention relates to yarn tensioning devices in general, and more particularly, is directed to a ball tension device suitable for use with horizontal yarn.

In the weaving and knitting industries, it is customary to tension the yarns by exerting a braking action on the yarns or threads to control tension on the yarn or thread as it is processed by the machine. Most prior art yarn tensioning devices were designed to treat vertical yarns inasmuch as the great majority of textile machinery is designed for operation with the yarn traveling in a vertical or substantially vertical path. U.S. Pat. No. 3,753,535 is exemplary of one prior art ball type tensioning device suitable for use with vertical yarns. Devices of the type described function well with yarns in vertical orientation but are completely unsuitable for use with machines wherein the yarns and threads are run in a horizontal path.

Other prior workers in the art have attempted to design yarn tensioning devices or yarn brakes for horizontal yarns as shown in U.S. Pat. Nos. 1,040,185, 1,372,557, 1,402,894, 1,211,862, 1,490,512, 1,167,636 and 3,383,072. All of these prior art tension braking devices however have certain disadvantages in that most are relatively complicated in construction. Others occupy considerable space. Some have not produced completely satisfactory results due in large part to the inertia of moving parts. Others have provided deficient in that they developed high friction which resulted in fiber and filament damage. In many instances, the prior art designs did not include suitable construction to accommodate knots and other irregularities in the yarns or threads.

SUMMARY OF THE INVENTION

The present invention relates generally to apparatus for compensating for tension variations in yarns or threads which are advanced into processing machines, and more particularly, is directed to a ball tension device suitable for use with horizontally advancing yarns.

The present invention incorporates a generally hollow body which defines a vertical interior channel within which is placed a plurality of weights in the form of balls, the number of which can be easily changed to vary the tension applied by the device. A pair of diametrically opposed openings are provided in the bottom of the body, which openings communicate with the bottom of the interior vertical channel. The openings are preferably inclined angularly downwardly and are machined or otherwise treated to receive therein a ceramic insert through which the yarn passes.

The inserts define ceramic lined conduits through which the horizontal yarn passes into and out of the ball tension device. The conduits angularly incline downwardly relative to the vertical axis of the body and are so positioned as to define a horizontal path through the device for yarn passage. The ceramic inserts are so oriented and so positioned within the vertical channel that the lowermost ball is always cradled in ceramic. The yarn or thread contacts only the ceramic inserts and the ball. The device is so constructed that there is no contact between the yarn and any plastic parts, thereby substantially eliminating wear.

The vertical interior channel is generally funnel shaped at the location of the inserts to direct the lowermost ball by gravity into a position whereby a portion of the periphery of the ball extends below the openings defined by the ceramic inserts or guides. The yarn passes through one guide opening, then below the bottom periphery of the lowest ball and thence outwardly through the opening defined by the second insert or guide. The yarn is kept in constant contact with the lower area of the ball by the downwardly angled orientation of the guides and by the funnel shape of the body channel in a manner which causes the ball to constantly rotate to thereby keep fiber and filament damage to a minimum. Knots and other irregularities in the yarn and thread are permitted to pass through the tension device by this construction without yarn damage simply by raising the balls within the vertical channel. The construction also serves to minimize the build up of oils, lint, waxes and other foreign matter which might otherwise occur.

It is therefore an object of the present invention to provide an improved horizontal ball tension device of the type set forth.

It is another object of the present invention to provide a novel ball tension device for horizontal yarn which comprises a minimum number of moving parts.

It is another object of the present invention to provide a novel ball tension device for horizontal yarn which comprises generally a hollow body defining a vertical, interior channel, at least one ball positioned within the vertical channel and means to direct a horizontal yarn horizontally through the device below the ball for yarn tensioning purposes.

It is another object of the present invention to provide a novel ball tensioning device for horizontal yarn including a body having an interior, vertical channel and a pair of diametrically opposed ceramic guides extending through the body wall in angular orientation and communicating with the bottom of the interior channel to provide a controlled path of travel for horizontal yarn.

It is another object of the present invention to provide a novel tension device for horizontal yarn which comprises a body defining a vertical channel, the channel terminating downwardly in a funnel-shaped chamber, a ball positioned within the channel and resting in the chamber and a pair of diametrically opposed inserts communicating with the chamber and forming seats for the ball whereby yarn passing through the inserts will be tensioned by the ball.

It is another object of the present invention to provide a novel tension device for horizontal yarn comprising a hollow body defining a vertical channel, a funnel-shaped chamber extending from the lower end of the channel in concentric relationship, a ceramic insert means extending through the body and communicating with the chamber in downwardly inclined relationship to provide a yarn path through the chamber and a ball positioned within the chamber for yarn tensioning, the yarn passing beneath the ball as it passes through the device.

It is another object of the present invention to provide a novel tension device for horizontal yarn comprising a hollow body, a pair of diametrically opposed ceramic inserts positioned at the bottom of the body and communicating with the interior of the body for passage of yarn horizontally therethrough and L-shaped bracket means extending from the body, the bracket means facilitating easy connection of the device to either horizontal or vertical members of a yarn processing machine.

It is another object of the present invention to provide a novel tension device for horizontal yarn that is inexpensive in manufacture, rugged in construction and trouble free when in use.

Other objects and a fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENT OF THE INVENTION

Figure 1:
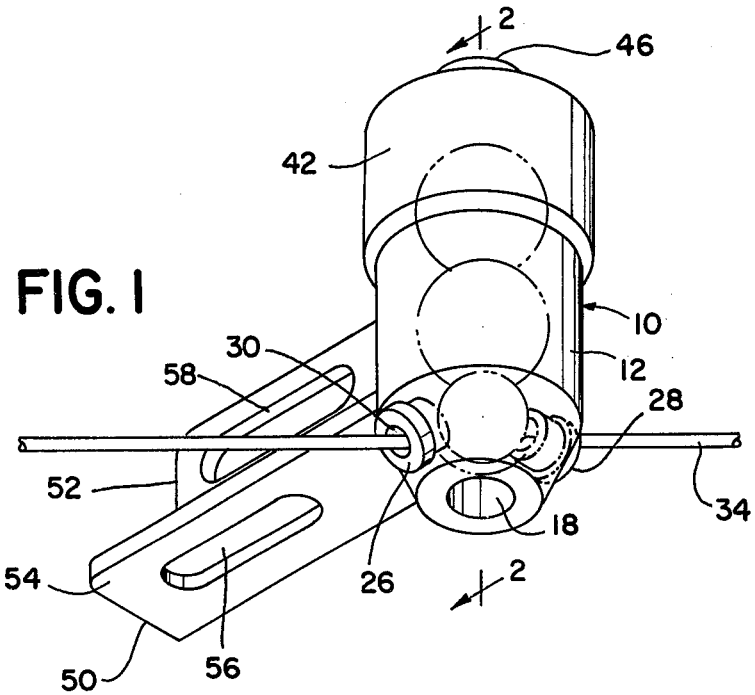
FIG. 1 is a perspective view of a tension device for horizontal yarn in accordance with the present invention.

Although specific terms are used in the following description for the sake of clarity, these terms are intended to refer only to the particular structure of the invention selected for illustration in the drawings and are not intended to define or limit the scope of the invention.

Figure 2:
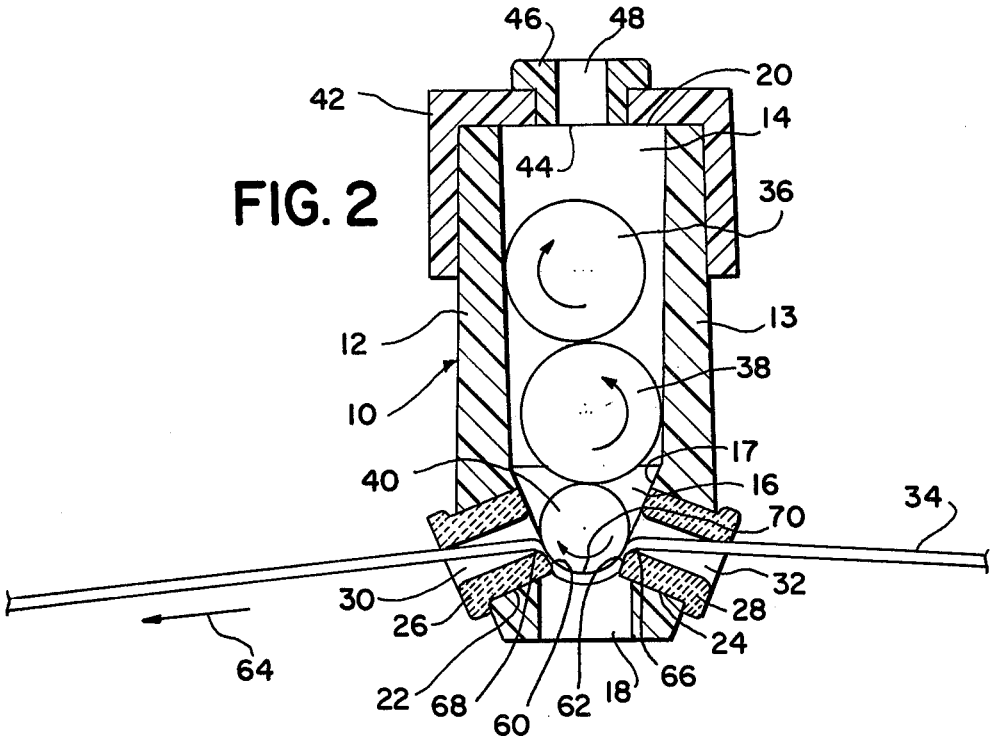
FIG. 2 is an enlarged cross sectional view taken along Line 2—2 of FIG. 1, looking in the direction of the arrows.

Referring now to the drawings, there is shown in FIGS. 1 and 2 a horizontal yarn tension device generally designated 10 comprising a body 12 having sidewalls 13 which define an interior, channel 14 of truncated, conical configuration. The conical sidewalls of the channel 14 incline gently inwardly from the top 20 to the bottom and the interior channel 14 is wider at the open top 20. Preferably, the body 12 is fabricated of a permanently transparent, impact resistant, chemically resistant polyamide plastic. The transparent plastic employed should be suitable for forming by injection molding, extrusion molding or blow molding in known manner and should be resistant to crazing. Further, for optimum results without undue deterioration or wear, the plastic should be stable when exposed to dilute alkalis, aliphatic and aromatic hydrocarbons, esters, ethers, trichlorethylene, carbontetrachloride, and mineral, vegetable and animal oils, fats and waxes. One plastic material found suitable for the purpose possesses the following properties:

| | |
|---|---|
| specific gravity | 1.12g/cm$^3$ |
| tensile yield at 73° F | 9,830 psi |
| elongation at yield at 73° F | 8.8% |
| tensile strength at 72° F. | 9,750 psi |
| ASTM Rockwell hardness at 73° F. | M-93 |
| Flammability | self-extinguishing |
| tensile impact S | 171 ft. lbs/in$^2$ |

As best seen in FIG. 2, the interior channel 14 is truncated conical in configuration and terminates downwardly in a funnel-shaped chamber 16. The sidewalls 17 of the funnel-shaped chamber 16 incline inwardly from the top junction at the vertical chamber 14 to the bottom opening 18 at a much greater inclination than the sidewalls 13 defining the upper chamber 14.

A pair of diametrically opposed, angularly inclined openings 22, 24 are drilled or otherwise provided in the sidewalls 17 in angular orientation from the horizontal. The openings 22, 24 communicate with the funnel-shaped chamber 16 near the bottom thereof. A pair of similar, ceramic inserts 26, 28 are pressed respectively into an opening 22, 24 to provide interior, ceramic seats 60, 62 upon which the lowermost ball 40 can rest. The inserts 26, 28 define respective angular conduits or channels 30, 32 through which the yarn 34 passes in a substantially horizontal path of travel.

As best seen in FIG. 2, the ceramic inserts 26, 28 incline downwardly from the vertical axis of the body 12 at an angle of more than 90° and less than 180°. An angular orientation between 120° and 135° has been found most advantageous. Still referring to FIG. 2, it will be noted that in a preferred embodiment, the longitudinal axes of the ceramic inserts 26, 28 intersect the plane defined by the inclined sidewalls 17 of the funnel-shaped channel 16 at substantially right angles. The intersection at this angle enhances tensioning at the seats 60, 62.

It will be noted that the path of travel of the yarn 34 through the yarn tension device 10 is through the angularly inclined conduit 32, beneath the lowermost ball 40 and then outwardly through the second angularly inclined conduit 30. The direction of yarn flow is indicated by the arrow 64, but the direction of flow can be reversed. The angular orientation of the ceramic inserts 26, 28 causes the yarn 34 to be positioned at the lowermost areas 66, 68 of the conduits 30, 32 as the yarn 34 enters and leaves the funnel-shaped channel 16. The positioning of the yarn 34 at the lowermost areas 66, 68 of the respective conduits 32, 30 at the funnel-shaped chamber 16 causes the yarn to pass beneath a lowermost portion 70 of the periphery of the lowest ball 40. The ceramic inserts 26, 28 preferably angle downwardly away from the vertical axis of the body 12 at precisely the same angular orientation to discourage any tendency of the yarn to crawl upwardly at either side. The angular orientation tends to thereby always direct the yarn 34 below the bottom of the lowermost periphery of the ball 40 as the yarn passes through the device 10.

The ball 40 is smaller in size than the balls 36, 38 and in the case of a light yarn, a small, relatively light ball 40 will be sufficient for initial tension purposes. The diameter of the ball 40 is designed to fit within the lowermost area defined between the seats 60, 62 of the ceramic inserts 26, 28 in a manner to assure that the ball 40 will always be cradled in ceramic. As illustrated, neither the ball 40 nor the yarn 34 will ever contact any of the plastic of the yarn tension device construction. Because of this, there is no tendency of the plastic to wear and all moving parts contact only the hard ceramic material forming the ceramic inserts 26, 28. Movement of the yarn 34 from right to left as illustrated in FIG. 2 beneath the ball 40 causes the ball to continuously rotate in the direction of the arrow. Rotation of the ball 40 keeps fiber and filament damage of the yarn 34 to a minimum and allows knots and other irregularities (not illustrated) to pass easily through the interior of the device 10. The rolling contact further minimizes the build up of oils, lint, waxes and other foreign matter, a condition which plagues other types of prior art static tensioning mechanisms.

In the case of heavier yarns or for any other reasons when it is desired to vary the tension of the device 10, additional weights in the form of spherical members, such as balls 36, 38 may be applied through the top opening 20 of the body 12. Balls of different weights and diameters may be used to achieve the desired tension and such additional weights may be used either singularly or in combination to create the desired results.

The device 10 is provided with a bottom opening 18 which communicates directly with the bottom of the funnel-shaped chamber 16 and indirectly with the bottom of the conical interior vertical channel 14. Lint, wax, dirt and other foreign material can pass directly through the interior of the device 10 by gravity and fall through the bottom opening 18 to thereby prevent such foreign matter from accumulating interiorly and clogging the yarn passage openings.

A cap 42 which is preferably fabricated of the same plastic as the body 12 overfits the top opening 20 and is a press fit thereon. The cap 42 acts to prevent foreign matter from entering the top 20 of the interior channel 14 and also serves to retain the balls 40, 38, 36 interiorly of the device 10. The cap 42 is formed with a concentric or other opening 44 which is equipped with a plastic or ceramic insert 46. In the preferred embodiment, the insert 46 is formed with an opening 48 therethrough, which opening communicates with the vertical interior channel 14. In this manner, air pressure can be applied at the opening 48 for interior channel cleaning purposes.

The yarn tension device 10 utilizes the principles of gravity in the form of one or more ball type weights 40, 38 36 and rolling friction of the lowermost ball 40 to apply a constant, predictable, easily adjustable tension on the yarn. It is contemplated that more or fewer balls can be inserted or removed from the interior channel 14 by using a pencil type magnet (not shown) in known manner. It will be noted that the yarn 34 travels through the yarn tension device 10 in a generally horizontal orientation without making any sharp turns or angles, thereby making it easier to run and maintain higher quality than heretofore possible with brittle yarn, spun yarns, flat yarns and delicate yarns.

In use, the yarn tension device 10 can be threaded by inserting a slightly curved, threading hook or needle of appropriate size through the conduits 30, 32 and displacing the ball or balls 40, 38, 36 upwardly. A loop of the yarn 34 is attached to the threading hook or needle (not shown) exteriorly of the device 10 and then the hook or needle is drawn backwardly through the conduits 32, 30, thereby drawing the yarn 34 through the device 10. With the curved needle removed from the interior channel defined between the conduits 30, 32, the lowermost ball 40 will position itself on the ceramic seats 60, 62 of the ceramic inserts 26, 28 and will tension the yarn 34 between the periphery of the ball 40 and the seats 60, 62.

A bracket 50 exteriorly affixes to the body 12 and is generally L-shaped in configuration. The bracket 50 comprises a horizontal base member or leg 54 from which a vertical leg 52 rises for respectively connecting the yarn tensioning device 10 to either a horizontal surface or vertical surface of a yarn processing machine (not illustrated). The horizontal leg 54 is provided with an elongated attaching opening 56 through which bolts, rivets or other fasteners may be positioned to attach the yarn tension device 10 in a desired location. Similarly, the vertical leg 52 is also provided with an elongated opening 58 which can be utilized to receive fasteners therethrough to connect the vertical leg 52 to a vertical surface of the yarn processing machine. The vertical and horizontal legs 52, 54 extend at right angles to the body 12 and are secured to the body in well known manner such as by employing a suitable adhesive.

Although the present invention has been described with a certain degree of particularity, it is understood that the present disclosure has been made only by way of example and that numerous changes in the details of construction and the combination and arrangement of parts may be resorted to without departing from the scope of the invention.

What is claimed is:

1. A ball tension device comprising a body having a longitudinal axis and defining a channel in which at least one ball can be positioned to vary yarn tension;

a first opening through the body communicating with the channel to define a yarn inlet passageway, a second opening through the body communicating with the channel to define a yarn outlet passageway;

at least one passageway being angularly inclined from the axis to define an angularly inclined conduit through which the yarn passes, said angular inclination being greater than ninety degrees, whereby the yarn is tensioned by the ball as it leaves the conduit and enters the channel.

2. The ball tension device of claim 1 wherein an insert is positioned within the angularly inclined conduit, the axis of the said insert being inclined to the same angular inclination as the conduit and wherein the yarn passes through the insert.

3. The ball tension device of claim 1 wherein the angularly inclined conduit inclines at an angle between more than 90° and less than 180° from the longitudinal axis of the body.

4. The ball tension device of claim 1 wherein the other said passageway is angularly inclined, said angularly inclined passageways being diametrically opposed.

5. The ball tension device of claim 4 wherein each of the angularly inclined passageways is lined with a hardened insert, said inserts providing respective, diametrically aligned, yarn conduits, one yarn conduit being inclined from the longitudinal axis of the body at an angle of between more than 90° and less than 180° and the other being inclined from the axis at an angle of between more than 180° and less than 270°.

6. The ball tension device of claim 2 wherein the insert defines a yarn inlet exteriorly of the body and a yarn outlet within the channel, a top portion of the yarn inlet being in a plane and a bottom portion of the yarn outlet being in the said plane whereby the yarn travels in a plane that is angularly offset from the axis of the insert.

7. The ball tension device of claim 6 wherein the plane is substantially horizontal.

8. The ball tension device according to claim 6 wherein the insert is so angularly oriented to the plane of travel of the yarn whereby the yarn contacts only a portion of the insert.

9. A ball tension device according to claim 1 wherein a pair of diametrically opposed, angularly inclined, conduits communicate with the bottom of the channel, said conduits being lined with inserts, at least a portion of said inserts defining a portion of the channel.

10. The ball tension device according to claim 9 wherein the said inserts define a seat therebetween, one of said balls being cradled on the seat to press a portion of a yarn between the ball and a portion of an insert.

11. A ball tension device in accordance with claim 1 wherein the channel terminates at the bottom thereof in a funnel-shaped section having conical sidewall and inserts positioned within the conical sidewall, said inserts defining a yarn passageway, said inserts terminating inwardly at the conical sidewalls to form a seat for the said ball whereby the said ball can press a portion of a yarn against a portion of an insert for yarn tensioning purposes.

12. The ball tension device according to claim 1 wherein the body channel terminates upwardly in an open end and means to close a portion of the open end to prevent a ball from escaping upwardly therethrough.

13. The ball tension device in accordance with claim 12 wherein the body terminates downwardly in a bottom opening, the said opening being smaller than the cross sectional diameter of the channel, the said opening communicating with the bottom of the channel to permit the escape of lint and dirt downwardly therethrough.

14. The ball tension device of claim 1 wherein the yarn passes horizontally through the angularly inclined conduit and including means to position the ball to displace the yarn downwardly from the horizontal path within the channel.

15. The method of tensioning a horizontal yarn passing in a substantially horizontal orientation through a ball tension device including one or more balls movable within a channel defined by sidewalls and having a longitudinal axis, comprising the steps of forming a yarn inlet and yarn outlet in the sidewalls in diametrically opposed relationship to provide a yarn inlet conduit and a yarn outlet conduit;

inclining the said yarn inlet conduit and yarn outlet conduit at an angle of greater than ninety degrees from the longitudinal axis;

inserting a yarn through the tension device inlet conduit in a radial inward direction in a substantially horizontal path and passing the yarn through the inlet conduit into the tension device interior channel;

passing the yarn outwardly from the channel through the conduit outlet in a radial outward direction in a substantially horizontal path;

displacing a portion of the yarn within the channel downwardly out of the substantially horizontal path defined by the yarn by pressing one of said balls against the yarn as it passes through the channel.

16. The method of claim 15 wherein the displacing of the yarn includes pressing the yarn against stationary portions of the yarn inlet and the yarn outlet.

17. The method of tensioning a yarn of claim 15, wherein the yarn passing through the inlet conduit is maintained in non-axial orientation relative to the conduit.

18. The method of claim 15 and the additional step of aligning the horizontal path of yarn travel into the channel and the horizontal path of yarn travel out of the channel in substantially diametrical alignment.

* * * * *